US008284977B2

(12) United States Patent
Ong

(10) Patent No.: US 8,284,977 B2
(45) Date of Patent: Oct. 9, 2012

(54) MULTI CHAMBER PORTED STEREO SPEAKER

(75) Inventor: Kok Huan Ong, Singapore (SG)

(73) Assignee: Creative Technology Ltd, Singapore (SG)

( * ) Notice: Subject to any disclaimer, the term of this patent is extended or adjusted under 35 U.S.C. 154(b) by 1127 days.

(21) Appl. No.: 12/019,536

(22) Filed: Jan. 24, 2008

(65) Prior Publication Data

US 2009/0190784 A1 Jul. 30, 2009

(51) Int. Cl.
*H04R 1/02* (2006.01)

(52) U.S. Cl. ..... 381/351; 381/345; 381/346; 381/358; 381/349; 381/353; 381/354; 381/182; 181/144; 181/145; 181/147

(58) Field of Classification Search ..... 381/182, 381/351, 345, 346, 358, 349, 353, 354; 181/144, 181/145, 147
See application file for complete search history.

(56) References Cited

U.S. PATENT DOCUMENTS

| | | | | |
|---|---|---|---|---|
| 5,147,986 | A * | 9/1992 | Cockrum et al. | 181/145 |
| 5,229,556 | A | 7/1993 | Geddes | |
| 5,818,942 | A * | 10/1998 | Freadman | 381/300 |
| 7,447,316 | B2 * | 11/2008 | Nakamura | 381/17 |
| 7,457,425 | B2 * | 11/2008 | Fincham | 381/302 |

* cited by examiner

*Primary Examiner* — Tom Thomas
*Assistant Examiner* — Benjamin Tzu-Hung Liu
(74) *Attorney, Agent, or Firm* — Creative Technology Ltd

(57) ABSTRACT

A method and apparatus for a multi-chamber ported stereo speaker is disclosed. The stereo speaker is a single unit with multi-chambers in an enclosure box. The multi chamber ported speaker comprises an enclosure housing a shared acoustic chamber having an external port for allowing air external of the enclosure box to flow into the shared acoustic chamber, and at least two additional chambers comprising a corresponding internal port in each additional chamber for forming an air pass from each additional chamber with the shared chamber, each additional chamber comprising a corresponding driver mounted through a wall of the chamber and enclosure box for forming the ported speaker.

10 Claims, 7 Drawing Sheets

190

MULTI CHAMBER PORTED STEREO SPEAKER

FIELD OF THE INVENTION

This invention relates to stereo speakers and more particularly to multi-chamber ported stereo speakers.

BACKGROUND OF THE INVENTION

A ported acoustical enclosure, also commonly referred to as bass-reflex, vented, or phase-inverted speakers, has an open duct, which includes a sound path that communicates the internal box volume of the enclosure with an external portion of the enclosure, in order to produce stronger and deeper low frequency. The box tuning frequency (Fb) of ported speaker is defined by the stiffness (Sv) 16 of the internal box volume of the enclosure and the air mass (Mo) 14 in the sound path of the port. The ported speaker 10 is illustrated in FIG. 1B and the equation is shown as below, which is equivalent to the simple harmonic motion of a spring system 12 shown in FIG. 1A.

$$Fb = \frac{1}{2\pi}\sqrt{\frac{Sv}{Mo}}$$

If an extra chamber 24, which has the same volume as the ported speaker, is added to the ported speaker, and the port is placed within a partitioning wall 26 between both chambers, the equivalent spring system 22 is shown in FIG. 2A, the box tuning frequency will increase to 1.414 times of single chamber ported speaker. The equivalent simple harmonic motion of a spring system 22 of the two chamber ported speaker 20 is represented by the equation:

$$Fb' = \frac{1}{2\pi}\sqrt{\frac{2Sv}{Mo}} \cong 1.414\,Fb$$

If a port 34 is placed within the front wall 36 of the extra chamber the resulting two chamber ported speaker 30 is shown in FIG. 3B. The equation of the equivalent spring system 32 shown in FIG. 3A has two tuning frequencies:

$$Sv' = \frac{Sv}{2}$$

$$F_{OL} = \frac{1}{2\pi}\sqrt{\frac{Sv \cdot Sv'}{(Sv + Sv')Mo}} = \frac{1}{\sqrt{3}} \cdot \frac{1}{2\pi}\sqrt{\frac{Sv}{Mo}} \cong 0.577\,Fb$$

$$F_{OH} = \frac{1}{2\pi}\sqrt{\frac{Sv + 2Sv}{Mo}} \cong 1.732\,Fb$$

The lower box tuning frequency of the dual chamber 30 is reduced to 0.577 times of single chamber ported speaker. The upper box tuning frequency of the dual chamber 30 is 1.732 times of single chamfer ported speaker. The two tuning frequencies can be adjusted by changing the port length (L), port cross section area (a) and volume of chamber (Vb). The related equation is:

$$Fb = \frac{ca}{2}\sqrt{\frac{1}{V_b \pi L}},$$

where c is speed or sound.

Additionally, conventional three chamber ported speakers are generally able to provide a lower frequency response than single or two chamber ported speakers, and reduce air turbulence noise, reduce excursion of driver and increase the power handling of driver. A typical three chamber ported speaker 40 is shown in FIG. 4B and consists of two drivers 14,44 mounted on partition walls between the chambers and in separate chambers 16,46, respectively, and sharing a common center chamber 24 having a port 34 which is producing low frequency. The equivalent spring system 42 is shown in FIG. 4A. However, even with conventional three chamber ported speakers the acoustical performance is also hampered by limited low frequency response and air turbulence noise.

There is thus a need to alleviate the problems associated with conventional ported stereo speakers. There is a need to provide a compact stereo speaker to enhance the acoustical performance and extend the low frequency response of stereo speakers and provide a stereo speaker with reduced excursion and increased power handling of a driver within the stereo speaker.

SUMMARY

An aspect of the invention provides a multi chamber ported speaker comprising an enclosure comprising a shared acoustic chamber having an external port for allowing air external of the enclosure box to flow into the shared acoustic chamber, and at least two additional chambers comprising a corresponding internal port in each additional chamber for forming an air passage from each additional chamber with the shared chamber, each additional chamber comprising a corresponding driver mounted through a wall of the chamber and enclosure box for forming the ported speaker.

In an embodiment, the multi chamber ported speaker comprises two drivers mounted within front wall of first and third chamber of the ported speaker. In one advantageous embodiment of the invention, two internal vents connect the first chamber and the second chamber, plus the second chamber and third chamber of the ported speaker. An external port allows the air from second chamber to have access to the air outside the ported speaker. The operation of internal port, external port and second chamber provide a low frequency response.

An aspect of an embodiment of the invention enables a ported speaker to operate with two drivers electrically connected via two independent stereo signals.

BRIEF DESCRIPTION OF THE DRAWINGS

In order that embodiments of the invention may be fully and more clearly understood by way of non-limitative example from the following description taken in conjunction with the accompanying drawings in which like reference numerals designate similar or corresponding elements, regions and portions, and in which.

DETAILED DESCRIPTION

Various other features and advantages will appear from the description to follow. In the description, reference is made to the accompanying drawings which from a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of invention. The following detailed description is therefore, not to be taken in a limiting sense, and the scope of the present invention is best defined by the appended claims.

Figure 1A:
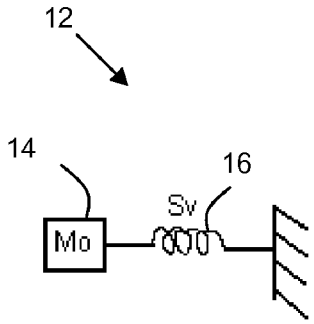
FIG. 1A PRIOR ART
FIG. 1A-B show a harmonic motion spring system (FIG. 1A) to depict a diagram of box tuning frequency (Fb) of a single chamber ported speaker (FIG. 1B)
Figure 1B:
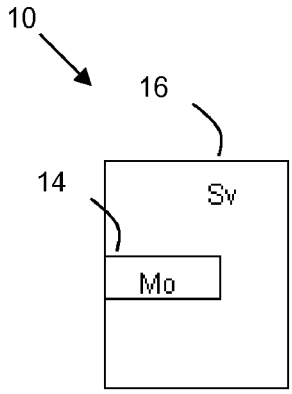
FIG. 1B PRIOR ART
Figure 2A:
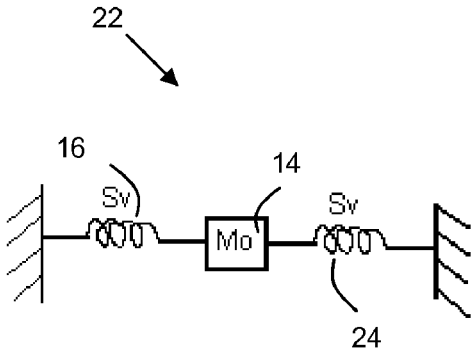
FIG. 2A PRIOR ART
FIG. 2A-B show a harmonic motion spring system (FIG. 2A) depicting box tuning frequency (Fb) if a two chamber ported speaker (FIG. 2B) with an additional speaker to the ported speaker shown in FIG. 1A-B.
Figure 2B:
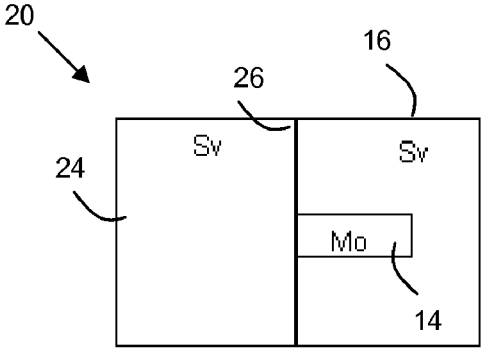
FIG. 2B PRIOR ART
Figure 3A:
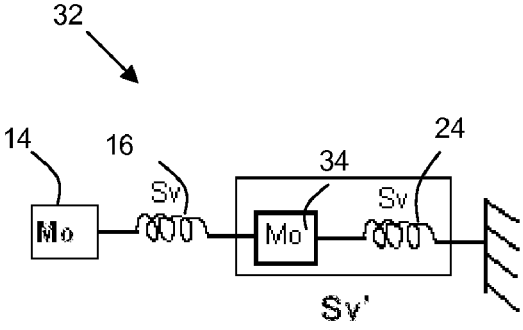
FIG. 3A PRIOR ART
FIG. 3A-B shows spring system showing harmonic motion (FIG. 3A) to depict two tuning frequencies of a two chamber ported speaker (FIG. 3B) having a port placed within a front all of the extra chamber to the ported speaker shown in FIG. 2A-B.
Figure 3B:
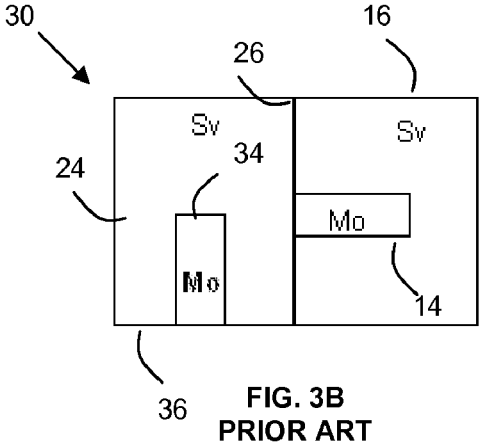
FIG. 3B PRIOR ART
Figure 4A:
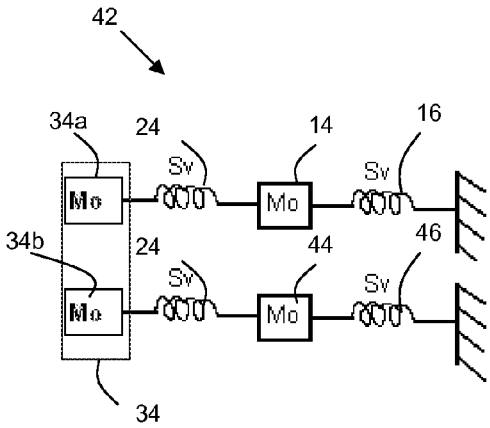
FIG. 4A PRIOR ART
FIG. 4A-B shows a spring system showing harmonic motion (FIG. 4A) to depict a three chamber ported speaker (FIG. 4B)
Figure 4B:
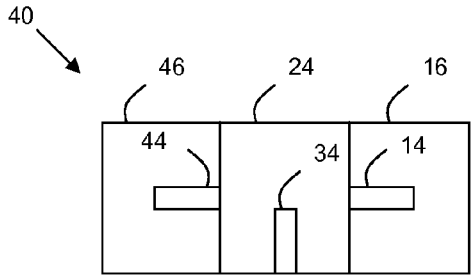
FIG. 4B PRIOR ART
Figure 5:
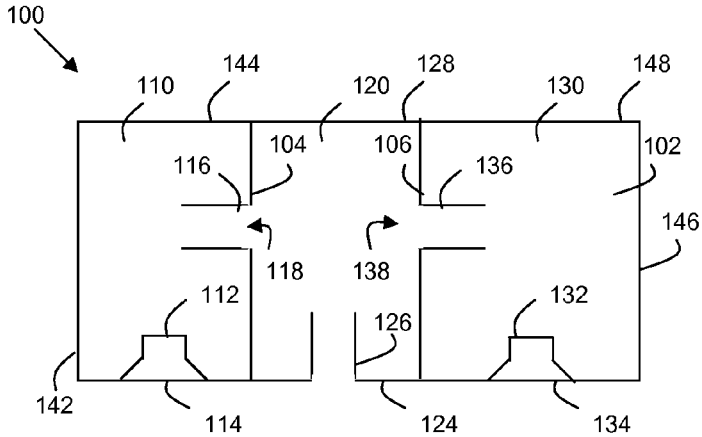
FIG. 5 is a schematic diagram of top view of a ported stereo speaker having three chambers, two drivers, one external port and two internal ports in accordance with an embodiment of the invention.

An apparatus and method is disclosed for enhancing the acoustic bass performance of a multi-chamber ported stereo speaker. An embodiment of the invention is shown in FIG. 5 showing a schematic diagram of a top view of a three chamber 110,120,130 ported stereo speaker 100. The ported stereo speaker 100 comprises an enclosure box 102 for housing three chambers 110,120,130 formed by walls and partitioning walls 104,106 to define the chambers. The speaker 100 has two loud speakers or drivers 112,132 (hereinafter "drivers") placed within a front wall 114,134, respectively, of the first 110 and third 130 chamber of the speaker 100. The speaker 100 also comprises three ports 126,116,136 placed within a front wall 124 of the second chamber 120, a partitioning wall 104 between the first chamber 110 and the second chamber 120, and a partitioning wall 106 between the second chamber 120 and the third chamber 130, respectively.

The interior of enclosure box 102 is divided by partitioning walls 104 and 106 into three chambers 110,120,130. Partitioning walls 104 and 106 have portions that form passageways 116 and 136. Passageways 116 and 136 may also be referred to as ports 116 and 136. Air within the first chamber 110 may pass from the first chamber 110 through port 116 to the second chamber 120. Similarly air within second chamber 120 may pass from the second chamber 120 through port 116 to the first chamber 110. Air within the third chamber 130 may pass from the third chamber 130 through port 136 to the second chamber 120. Similarly air within the second chamber 120 may pass from the second chamber 120 through the port 136 to the third chamber 130. With this configuration, port 116 and 136 are faced to internal chamber 110, 120, 130 of enclosure box 102, port 116 and 136 are referred to as "internal" ports.

The front wall 124 of the second chamber and of the enclosure box 102 has portions that form a passageway or port 126. Air within second chamber 120 may pass from second chamber 120 through port 126 to the air located outside of enclosure box 102. Similarly, the air located outside of enclosure box 102 may pass through port 126 to second chamber 120. With this configuration, since port 126 is faced to outside of enclosure box 102, port 126 is sometimes referred to as an "external" port. Since the air in the second chamber 120 and air pass through port 126 is not directly vibrated from the drivers 112,132, air turbulence noise is limited. It will be appreciated that the external port 126 may be configured on any number of external walls of the second chamber 120 and enclosure box 102. For example the port 126 may be formed on the back or rear wall 128, or top or bottom wall of the second chamber 120, or front wall 124. There may be either a single external port or a plurality of external ports. If there are plurality of external ports, a similar audio response is obtained as a single external port configuration if a cross-sectional area of the single external port is the same as a summation of cross-sectional areas of the plurality of external ports. Advantageously, locating the external port 126 close to a wall adjacent to either of the drivers 112,132 may cause generation of a direct and louder bass.

The configuration of the speaker 100 shares a common air passage between all three chambers 110,120,130. The air passage of the second chamber 120 is shared with the first 120 and third 130 chambers. This configuration allows crosstalk of the low frequency of stereo signals in particular to passband 20 Hz up to 500 Hz. Internal vents 118,138 connect the first chamber 110 and the second chamber 120 and the third chamber 130 and the second chamber 120. The dimensions of vents 118,138 are primarily dependent on parameters relating to driver rating and enclosure size. The low frequency of stereo signals depends on tuning of the enclosure box and extending the low frequency response of the speaker. This configuration advantageously also reduces the air turbulence noise of ports, compared to conventional stereo left and right speakers.

The drivers 112,132 are arranged in FIG. 5 as mounted on the front walls 114,134 of the first 110 and third 130 chambers respectively. It will be appreciated that the drivers 112,132 may be arranged on any wall forming an external wall of the enclosure box 102 and chambers 110,130 such as side walls 142,146, rear or back walls 144,148, top or bottom walls (not shown). For example, the drivers may be arranged on corresponding side walls 142,146 of the first 110 and third 130 chambers. The drivers 112,132 do not necessarily need to be arranged on the corresponding same wall of each chamber as shown in FIG. 5, the drivers 112,132 may be arranged in any configuration on an external wall of each chamber, for example driver 112 on the front wall 114 of the first chamber 110 and driver 132 on the side wall 146 of the third chamber 130.

Figure 9A:
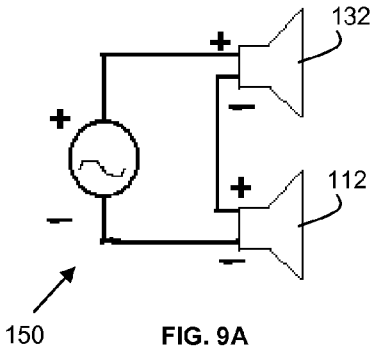
FIG. 9A-C show various two driver connection diagrams of ported speaker of an embodiment of the invention.
Figure 9B:
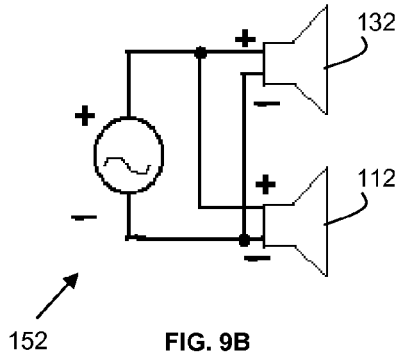
Figure 9C:
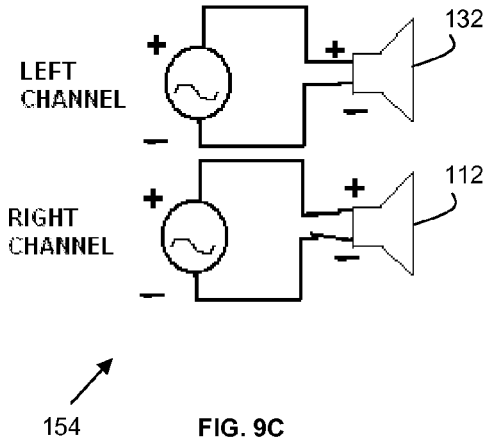

Both drivers 112,132 are arranged to be electrically connected—via two independent stereo sources. FIG. 9A-C show various two driver connection diagrams 150,152,154 of embodiments of the invention. With this configuration, there is no need for a sub-woofer and power is conserved since the only power consumed is by the drivers 112,132. Since driver excursion is reduced, the respective power rating of the drivers 112,132 is correspondingly increased. The drivers 112, 132 are shown in a series connection in FIG. 9A. FIG. 9B shows the drivers 112,132 in a parallel connection. FIG. 9C shows the stereo connection to driver 112,132.

Figure 6:
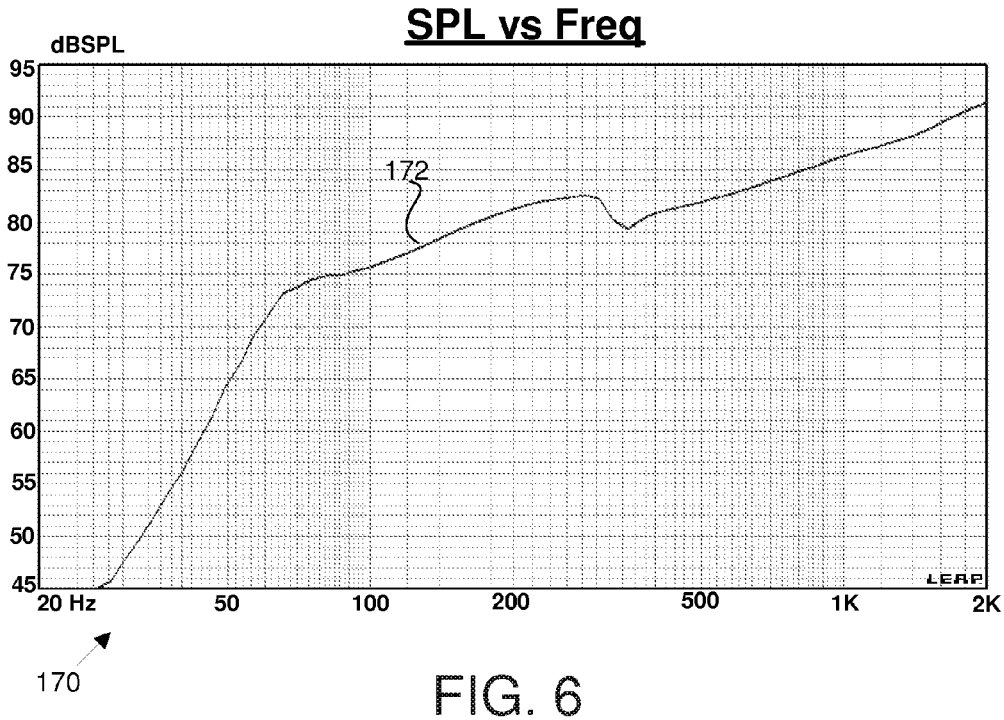
FIG. 6 is a frequency response chart showing the gain of the ported speaker of an embodiment of the invention shown in FIG. 5 as a function of frequency.

FIG. 6 is a frequency response chart 170 showing the gain of the ported speaker 100 as a function of frequency. It can be seen from the curve 172 and the data in the frequency response chart that the enclosure within ported speaker 100 is tuned to 70 Hz. The curve 172 denotes conditions where the volume of chambers 110,120,130 is each individually equal to 300 c.c., and the drivers 112, 132 are two inch drivers.

Figure 7:
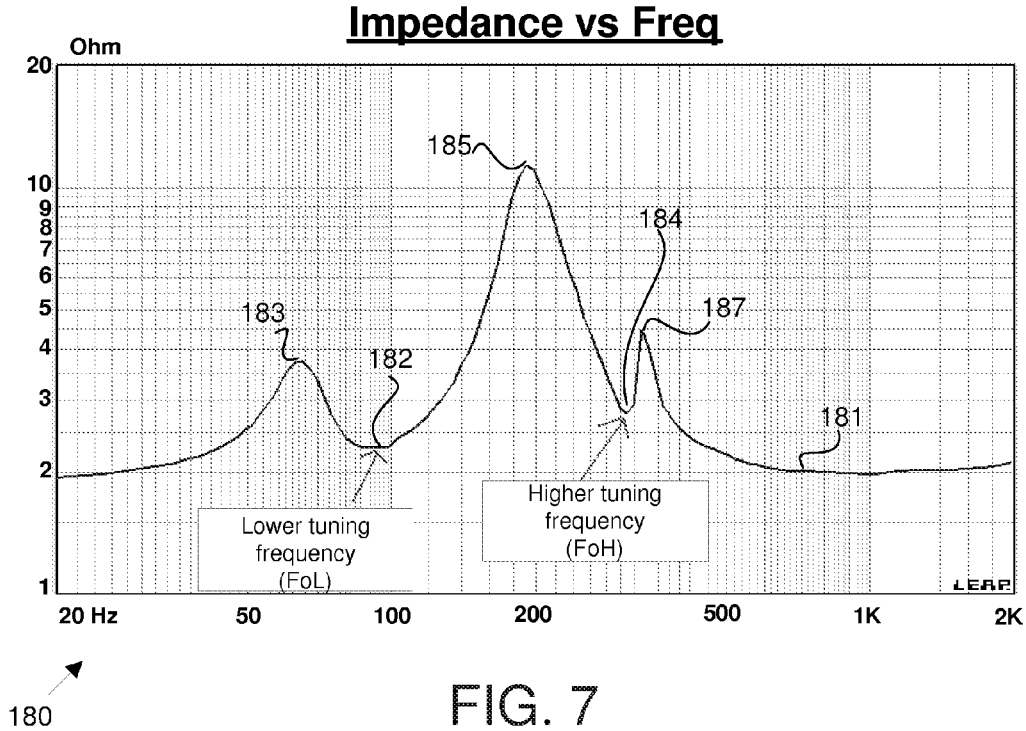
FIG. 7 is an impedance response chart showing the impedance of the ported speaker of an embodiment of the invention shown in FIG. 5.

FIG. 7 is an impedance response chart 180 showing the impedance of the ported speaker 100. There are three peaks 183,185,187 denoted in impedance curve 181. There are two box tuning frequencies 182,184, at approximately 70 Hz and 300 Hz, respectively. At approximately 70 Hz and 300 Hz, the excursion of drivers 112,132 is at a minimum, and as such the power handling of the drivers 112,132 correspondingly increases.

Figure 8:
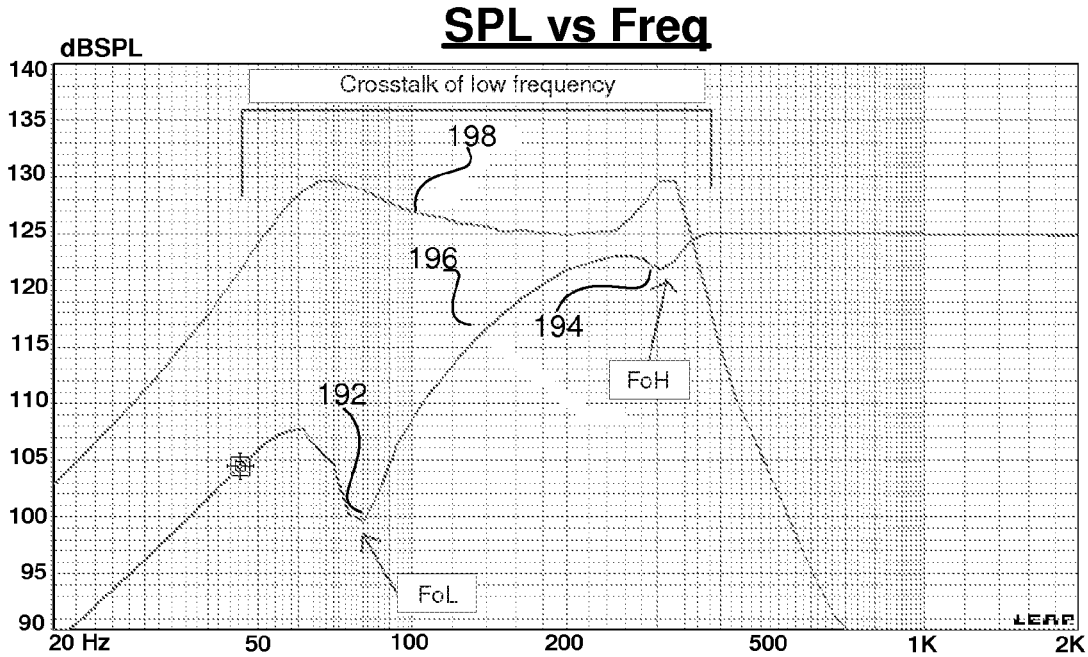
FIG. 8 is a near field frequency response chart showing the gain of the driver and external port of ported speaker of an embodiment of the invention shown in FIG. 5.

FIG. 8 is a near field frequency response chart 190 showing the gain of the drivers 112,132 and external port 126 of ported speaker 100 across the crosstalk of low frequency. Curve 198 denotes the near field frequency response of the external port 126; while curve 196 denotes the near field frequency response of the drivers 112,132 showing points of lower tuning frequency (FoL) 192 and higher tuning frequency (FoH) 194.

Figure 10:
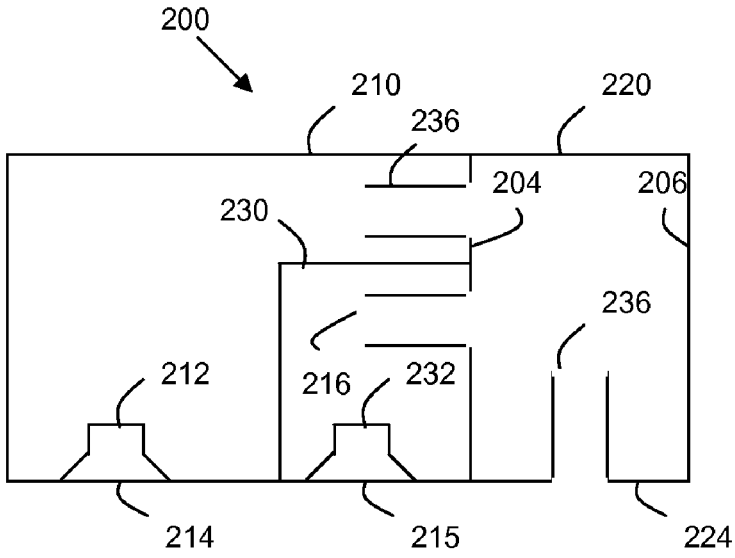
FIG. 10 is a schematic diagram of top view of a ported speaker having three chambers, two drivers, one external port and two internal ports, which is another implementation of structure of ported stereo speaker of an embodiment of the invention.

The subsequent figures illustrate the non-limitive nature of the present invention. FIG. 10 denotes a schematic diagram of another embodiment of the invention. A multi-chamber ported speaker 200 is shown of from a top view. The ported speaker 200 includes three chambers 210,220,230, two drivers 212,232, one external port 236, and two internal ports 216,226. The two drivers 212,232 are respectively mounted at front walls 214,215 of first 210 and third 220 chambers of the ported speaker 200. The external port 236 is located at the second or shared chamber 220 on the front wall 224. The two internal ports 216,226 are located at partitioning wall 204 in between the first 210, the second 220 and the third 230 chambers, respectively.

Figure 11:
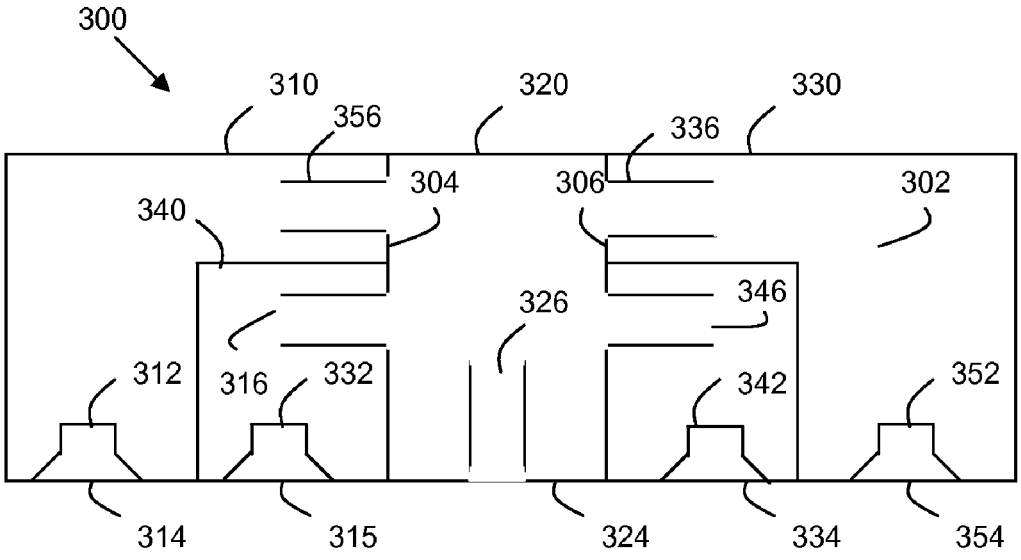
FIG. 11 is a schematic diagram of top view of a ported speaker having five chambers, four drivers, one external port and four internal ports, which is another configuration of a structure of a ported stereo speaker of an embodiment the invention.

FIG. 11 is a schematic diagram of top view of yet another embodiment of the invention. There is provided a ported speaker 300 having five chambers 310,320,330,340,350, four drivers 312,332,342,352, one external port 326 and four internal ports 316,336,346,356 which is in another embodiment of the present invention. This embodiment is similar to the previous embodiment denoted in FIG. 10 with an additional two chambers, fourth and fifth chambers 240,250.

It will be appreciated that any of the additional chambers having internal ports with air passing to the shared chamber (second chamber) may be positioned and arranged such that the air passages are in any wall of the shared chamber.

Figure 12:
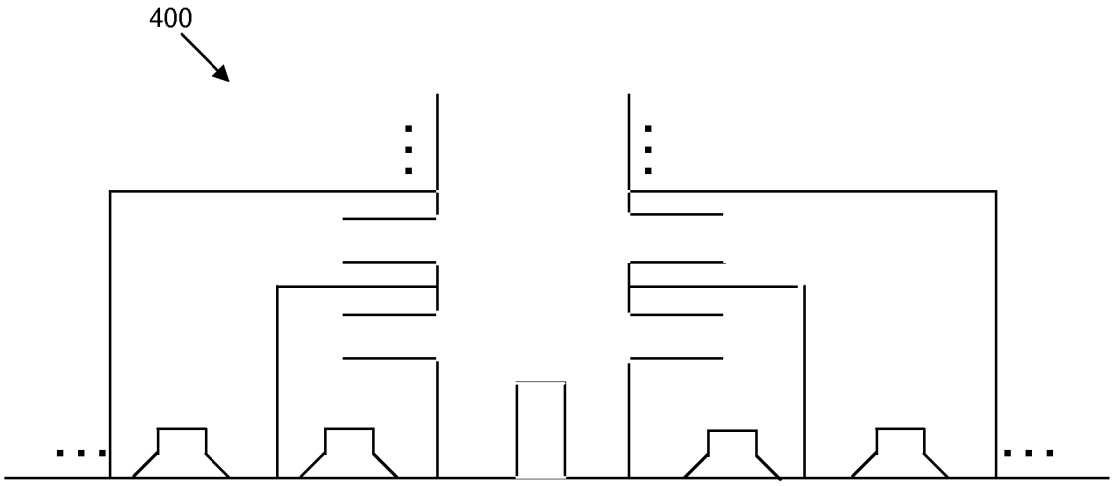
FIG. 12 is a schematic diagram of top view of a ported speaker having n+1 chambers, n drivers, one external port and N internal ports, which is another configuration of structure of ported stereo speaker of an embodiment of the invention.

FIG. 12 is a schematic diagram of top view of a ported speaker having n+1 chambers, n drivers, one external port and n internal ports, which is another embodiment of the present invention. The number of drivers and/or internal ports n is a natural number.

In embodiments, the dimensions of ports are primarily dependent on a desired tuning frequency. The desired tuning frequency determines dimensions of the ports, and it is not necessary for the external and internal ports to have identical dimensions unless the desired tuning frequency dictates that it should be as such. Additionally, the number of drivers should be an even number as shown when generating audio with stereo sound. It is preferable to employ an even number of drivers to ensure equality of sound being generated for the left and right channels.

In the construction of embodiments of the ported speaker, the material used for the enclosure box and partition walls should not absorb or damp sound waves. Materials like plastics (ABS or PS) and wood (particle or MDF) are typically employed for use in the speakers. The construction of the chamber need not include walls at right angles with each other as shown and may be of any shape. A consideration in relation to chamber shape design relates to standing waves being generated within the chamber, with the standing waves being a significant factor in adversely affecting sound reproduction from the speaker. However, the adverse effects caused by standing waves may be minimized by employing sound damping material within the chamber.

While embodiments of the invention have been described and illustrated, it will be understood by those skilled in the technology concerned that many variations or modifications in details of design or construction may be made without departing from the present invention.

What is claimed is:

1. A multi chamber ported speaker comprising:

(a) an enclosure box housing an acoustic chamber positioned between a first additional chamber and a second additional chamber;

(b) a first partition wall for partitioning the first additional chamber and the acoustic chamber;

(c) a second partition wall for partitioning the second addition chamber and the acoustic chamber;

(d) each of the first and second additional chambers comprises at least one internal port for forming at least one air passage between each corresponding additional chamber and the acoustic chamber, the internal port of the first additional chamber and the internal port of the second additional chamber corresponding to at least one passageway associable with the first partitioning wall and at least one passageway associable with the second partitioning wall respectively;

(e) the first and second additional chambers each having a corresponding driver mounted through a wall of the chamber and enclosure box for forming the ported speaker, the first partition wall is adjacent the driver in the first additional chamber and the second partition wall is adjacent the second additional chamber; and (f) the acoustic chamber has an external port for allowing air external of the enclosure box to flow into the acoustic chamber, wherein the external port is close to the first and second partition walls adjacent to either of the drivers.

2. The multi chamber ported speaker of claim 1 wherein the drivers of the additional chambers are arranged in the same plane of an enclosure.

3. The multi chamber ported speaker of claim 1 wherein the ports of the additional chambers are formed in the same plane of a wall of the shared chamber.

4. The multi chamber ported speaker of claim 1 wherein there are n+1 additional chambers, wherein n is a natural number.

5. The multi chamber ported speaker of claim 1 further comprising internal vents arranged to provide additional air passages between an additional chamber and the shared chamber.

6. The multi chamber ported speaker of claim 1 wherein the corresponding drivers of two additional ports are paired in series.

7. The multi chamber ported speaker of claim 1 wherein the corresponding drivers of two additional ports are paired in parallel.

8. The multi chamber ported speaker of claim 1 wherein the corresponding drivers of two additional ports are paired via two independent stereo sources.

9. The multi chamber ported speaker of claim 1 wherein the arrangement of the air passage between the additional chambers and the shared chamber limits the excursion of the drivers.

10. The multi chamber ported speaker of claim 1 wherein the drivers of each additional chamber and the external port of the shared chamber are aligned along the same surface of the ported speaker along a plane of the enclosure.

* * * * *